US011072445B2

(12) United States Patent
Van Den Elzen et al.

(10) Patent No.: US 11,072,445 B2
(45) Date of Patent: Jul. 27, 2021

(54) DEVICE FOR PACKAGING PRODUCTS AND ARRAY OF PACKAGED PRODUCTS

(71) Applicant: MARS, INCORPORATED, McLean, VA (US)

(72) Inventors: Marinus J. H. M. Van Den Elzen, Veghel (NL); Albertus C. H. Van Liempd, Veghel (NL)

(73) Assignee: MARS, INCORPORATED, McLean, VA (US)

( * ) Notice: Subject to any disclaimer, the term of this patent is extended or adjusted under 35 U.S.C. 154(b) by 266 days.

(21) Appl. No.: 16/289,028

(22) Filed: Feb. 28, 2019

(65) Prior Publication Data

US 2019/0193875 A1 Jun. 27, 2019

Related U.S. Application Data

(60) Division of application No. 14/060,103, filed on Oct. 22, 2013, now Pat. No. 10,259,601, which is a continuation of application No. 10/568,000, filed as application No. PCT/EP2004/051843 on Aug. 19, 2004, now Pat. No. 8,590,279.

(30) Foreign Application Priority Data

Aug. 20, 2003 (EP) ..... 03103206

(51) Int. Cl.

| | |
|---|---|
| ***B65B 5/02*** | (2006.01) |
| ***B65B 9/04*** | (2006.01) |
| ***B65B 25/00*** | (2006.01) |
| ***B65B 35/10*** | (2006.01) |
| *B65B 51/22* | (2006.01) |

(52) U.S. Cl.

CPC ..... *B65B 5/02* (2013.01); *B65B 9/045* (2013.01); *B65B 25/005* (2013.01); *B65B 35/10* (2013.01); *B65B 51/225* (2013.01)

(58) Field of Classification Search

CPC ..... B65B 5/02; B65B 9/045; B65B 25/005; B65B 35/10; B65B 51/225

USPC ..... 53/453

See application file for complete search history.

(56) References Cited

U.S. PATENT DOCUMENTS 4,034,536 A * 7/1977 Mahaffy ..... B29C 51/22 53/427
4,154,636 A * 5/1979 Motoyama ..... A61J 3/005 156/243
4,604,852 A * 8/1986 Becker ..... B65B 9/02 53/148

(Continued)

*Primary Examiner* — Praachi M Pathak

(57) ABSTRACT

A method for packaging products, such as candies, wherein the products are positioned on a first sheet which is continuously moved in a transport direction, wherein the products are covered by a second sheet which is continuously moved in the same transport direction and which is aligned substantially plane-parallel to the first sheet, and wherein the first and second sheets are sealed together near the outer edges of the individual products or grouped products by a sealing device, wherein the sealing device comprises sealing ribs extending substantially transversely to the transport direction on one side of the moving sheets, wherein said sealing ribs are being moved at the same speed as the sheets and the sealing ribs seal the first and second sheets together in between the moving products.

10 Claims, 4 Drawing Sheets

(56) References Cited

U.S. PATENT DOCUMENTS

| | | | | | |
|---|---|---|---|---|---|
| 5,268,179 | A * | 12/1993 | Rudella | A61K 9/7084 | 156/73.1 |
| 5,459,980 | A * | 10/1995 | Kenney | B65B 29/02 | 53/373.4 |
| 5,752,365 | A * | 5/1998 | Johnson | B65B 61/08 | 53/389.2 |
| 7,007,443 | B2 * | 3/2006 | Liedtke | B65B 15/04 | 53/399 |
| 7,516,596 | B2 * | 4/2009 | Henderson | B26F 1/14 | 206/494 |
| 8,505,716 | B2 * | 8/2013 | Van Liempd | B65B 9/045 | 206/216 |
| 8,590,279 | B2 * | 11/2013 | Van Den Elzen | B65B 9/045 | 53/453 |
| 2002/0157355 | A1 * | 10/2002 | Tampieri | B29B 13/023 | 53/453 |
| 2004/0226849 | A1 * | 11/2004 | Brenkus | B65B 9/20 | 206/484 |
| 2006/0218880 | A1 * | 10/2006 | Sperry | B29C 65/229 | 53/403 |
| 2011/0244315 | A1 * | 10/2011 | Yoon | H01M 2/0207 | 429/176 |

* cited by examiner

DEVICE FOR PACKAGING PRODUCTS AND ARRAY OF PACKAGED PRODUCTS

The invention relates to a method for packaging products, such as candies, in a removable enclosure, wherein the products are positioned on a first sheet which is continuously moved in a transport direction, wherein the products are covered by a second sheet which is continuously moved in the same transport direction and which is aligned substantially plane-parallel to the first sheet, and wherein the first and second sheets are sealed together near the outer edges of the individual products or grouped products by a sealing device.

Such a method is used for providing a bandoleer of individually packaged products or of products that are grouped together in one sealed envelope, wherein the envelopes can be separated from each other at a later stage. The invention aims at an improved method, wherein products can be wrapped efficiently at a fast speed, wherein the packaging device can be easily adapted for differently sized products, wherein as little packaging material as possible is used, and/or wherein brittle products can be wrapped with as little damage possible.

To that end the sealing device comprises sealing ribs extending substantially transversely to the transport direction on one side of the moving sheets, wherein said sealing ribs are being moved at the same speed as the sheets and the sealing ribs seal the first and second sheets together in between the moving products. Thereby the sheets can move continuously, without the need to interrupt the movement for sealing the sheets together. Preferably the sealing device comprises a rotating frame, the rotation axis of said frame extending transversely to the transport direction, wherein said sealing ribs extend from a coaxial cylindrical surface of said frame.

In order to prevent damage to the products, in particular if the products have a substantial height, at least one of said sheets is preferably pre-shaped to fit at least partially around the products before the film comes into contact with the products. Said pre-shaping action is preferably performed by a pre-shaping device comprising a first rotating shaping frame on one side of the moving sheet and a second rotating shaping shape on the opposite side of the moving sheet, the rotation axes of both frames extending transversely to the transport direction of the sheet, wherein said frames comprise co-operating protruding shaping ribs extending substantially transversely to the transport direction, wherein the shaping ribs of both frames move between each other, and wherein said shaping ribs are being moved at the same speed as the pre-shaped sheet. Preferably the first pre-shaping frame is positioned such that it guides the pre-shaped film towards the other moving sheet while including the products. Preferably the first pre-shaping frame is the same frame as the rotating frame of the sealing device, and the shaping ribs on said frame are said sealing ribs.

The described method is particularly advantageous when the products have an elongated form and are positioned transversely on the first moving sheet. Preferably the sealing ribs comprise ultrasonic welding means. Preferably the sealed areas between the products are perforated or scored, such that the packaged products stay attached to each other, but can be easily separated.

The invention also relates to a device for packaging products, such as candies, comprising first transport means for continuously moving a first sheet in a transport direction, positioning means for positioning the products on the first sheet, second transport means for continuously moving a second sheet in the same transport direction in alignment substantially plane-parallel to the first sheet while covering the products, and a sealing device for sealing the first and second sheets together near the outer edges of the individual products, wherein the sealing device comprises protruding sealing ribs extending substantially transversely to the transport direction, and said sealing device further comprises synchronizing means for moving said sealing ribs at the same speed as the sheets while sealing the first and second sheets together in between the moving products.

Furthermore the invention relates to a method for packaging products, such as candies, wherein the products are positioned on a first sheet which is continuously moved in a transport direction, wherein the products are covered by a second sheet which is continuously moved in the same transport direction and which is aligned substantially plane-parallel to the first sheet, and wherein the first and second sheets are sealed together near the outer edges of the individual products by a sealing device, wherein at least one of said sheets is pre-shaped by a pre-shaping device to fit at least partially around the products before the sheet comes into contact with the products, wherein said pre-shaping device comprises a first rotating shaping frame on one side of the moving sheet and a second rotating shaping frame on the opposite side of the moving sheet, the rotation axes of both drums extending transversely to the transport direction of the sheet, wherein said frames comprise co-operating protruding shaping ribs extending substantially transversely to the transport direction, wherein the shaping ribs of both frames move between each other, and wherein said shaping ribs are being moved at the same speed as the pre-shaped sheet.

The invention also relates to a device for packaging products, such as candies, comprising first transport means for continuously moving a first sheet in a transport direction, positioning means for positioning the products on the first sheet, second transport means for continuously moving a second sheet in the same transport direction in alignment substantially plane-parallel to the first sheet while covering the products, a sealing device for sealing the first and second sheets together near the outer edges of the individual products, and a pre-shaping device for pre-shaping at least one of said sheets to fit at least partially around the products before the sheet comes into contact with the products, wherein said pre-shaping device comprises co-operating protruding shaping ribs extending substantially transversely to the transport direction, wherein the shaping ribs of both drums are movable between each other, and said pre-shaping device further comprises synchronizing means for moving said shaping ribs at the same speed as the pre-shaped sheet.

Further the invention relates to an array of packaged products, such as candies, comprising two sheets which are sealed together and enclose said products or groups of products, wherein the sealed areas between the products are weakened, for instance by scores of perforations, such that the packaged products can be easily separated, wherein one of said sheets is a substantially flat relatively rigid board or film and the other sheet is a relatively flexible foil shaped to fit at least partially around the products. Preferably the sides of the sealed sheets extending from the outer ends of the products are bend, upwards or downwards, in order to give the array rigidity in its longitudinal direction. In this manner a very efficiently packaged product is obtained. The extending sides of the sealed sheets can be given such a length that they can be bend further, over the packaged products and be sealed together, such that the rigid board forms a protective tubular box.

The invention will be illustrated with reference to the drawings, wherein.

Figure 1:
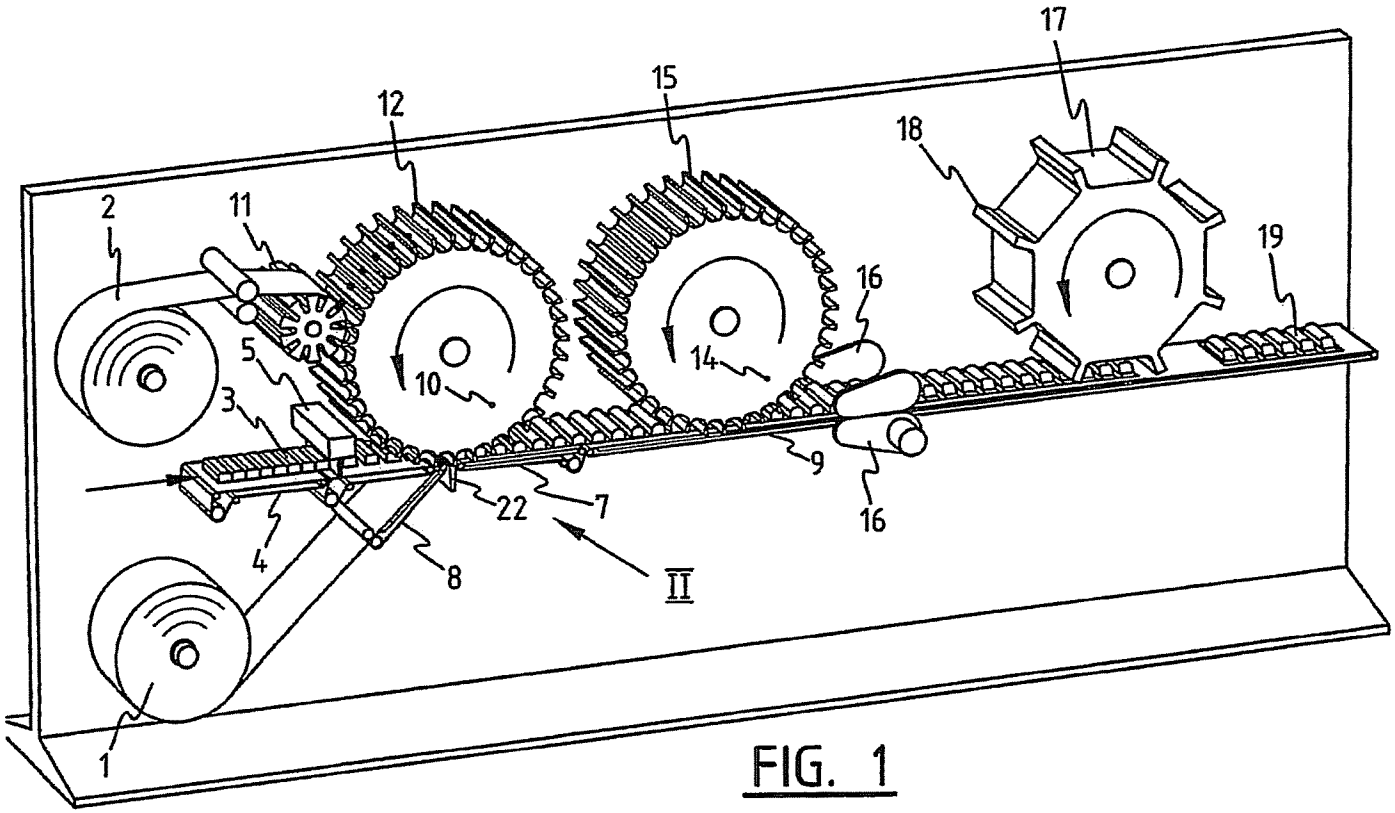
FIG. 1 shows a schematic perspective view of a packaging device.
Figure 2:
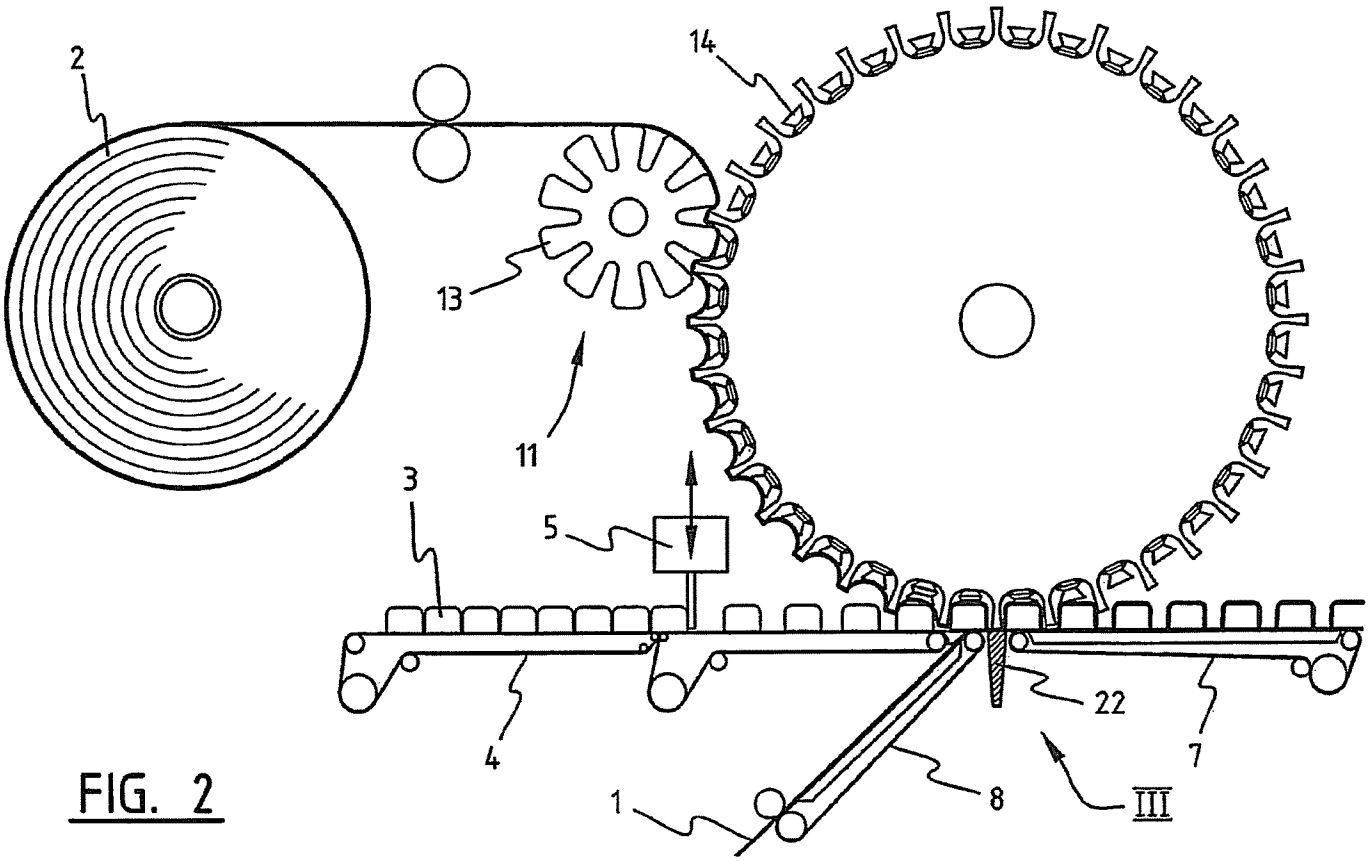
FIG. 2 shows a schematic side view of a detail of the packaging device of FIG. 1.
Figure 3:
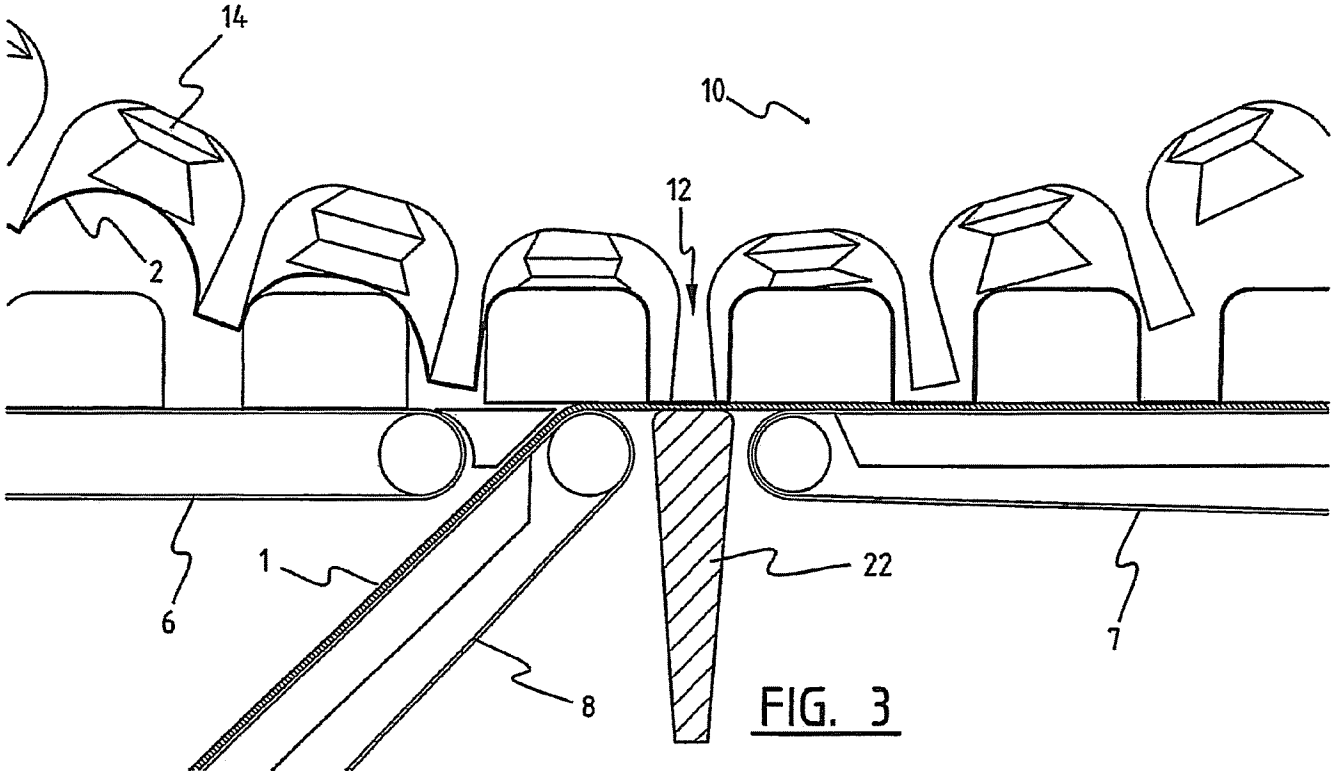
FIG. 3 shows a further schematic side view of a detail of the packaging device of FIG. 1.

With reference to FIGS. 1, 2 and 3 the packaging device has a first roll of card board 1 having a plastic coating on at least one side and a second roll of plastic film 2. The elongated candy bars 3 are placed transversely on a first endless conveyor 4. A separation device 5 has a barrier which moves up and down at regular intervals for spacing the candy bars 3 a pre-defined distance apart.

The second conveyor 6, the third conveyor 7, the fourth conveyor 8, the fifth conveyor 9, as well as the card board 1 all move at the same speed, which is larger than the speed of conveyor 4 in order to accommodate the larger mutual distance of the candy bars.

The plastic film 2 is led between a co-operating rotating shaping drums 10, 11. Both drums 10, 11 have protruding shaping ribs 12, 13 which during rotation are moved between each other like a gear unit, thereby corrugating the plastic film 2 into the desired shape. The drum 10 has flexible suction cups 14 between its ribs 12 which hold the pre-shaped film by a vacuum action force.

The pre-shaped film 2 is placed on top of the moving candy bars 3 by the drum 10 while they are at the same time being transferred by the conveyor 6 onto the coated side of moving cardboard 1. In this manner the candy bars 3 are enclosed in the cardboard 1 and the pre-shaped plastic film 2. When the ribs 12 are at their lowest point 2 they push the plastic film 2 onto the cardboard 1, where the plastic film 2 is welded on the coated side of cardboard 1 by a first ultrasonic welding device 22, which co-operate with ultrasonic welding means present in the sealing ribs 12. In this manner a series of interconnected tubes is formed, each tube comprising a candy bar. By changing the opening time of the separation device 5 also two or more candy bars 3 can be grouped together and enclosed in a single tube thereby.

Subsequently the transverse seals between the candy bars 3 are perforated or scored by a rotating drum 24 having scoring or perforating ribs 15. Then the ends of the film 1 which extend from the sides of the candy bars 3 are pushed down by two further ultrasonic sealing devices 16 and sealed to the cardboard 1, whereby the candy bars 3 are enclosed inside the cardboard and plastic film in an airtight manner. At this stage the candy bars 3 form an endless array of interconnected packaged products. The separation drum 17 separates the products into arrays 19 of for instance six candy bars each by means of cutting ribs 18.

Figure 4:
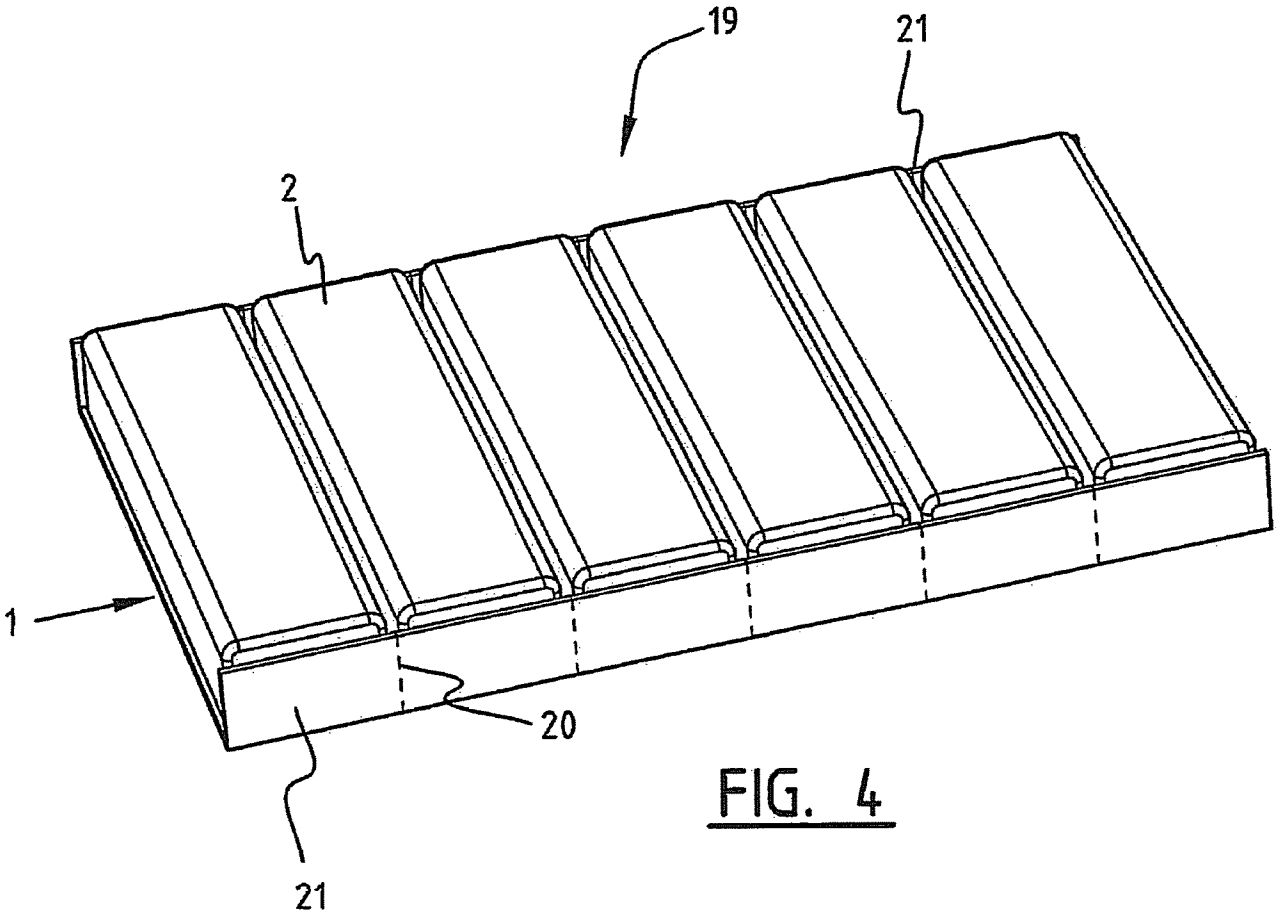
FIG. 4 shows a perspective view of an array of packaged products.

The array 19 of candy bars 3 as shown in FIG. 4 thereby has a cardboard layer 1 on the bottom side and a shaped plastic film layer 2 on the top side which is sealed onto the cardboard layer 1 in between the candy bars 3. These transverse seals have scores or perforations 20 so that individual products can be easily torn off, without breaking the seal. Both sealed longitudinal sides 21 of the package are folded upwards, giving the array 19 such rigidity that it can subsequently be treated as a box. The array 19 can be shipped to and exposed in shops, and sold to the public, without the need to enclose it in a further layer of plastic, as is the case with prior art packaging methods of candy bars.

The invention claimed is:

1. A device for packaging products comprising:

a conveyor for moving individual or grouped products in a transport direction;

a first transport drive for continuously moving a bottom, planar first sheet in said transport direction;

a separation device for positioning said products in spaced-apart relation on the first sheet;

a second transport drive for continuously moving an upper second sheet that is separate from the first sheet in said transport direction and into alignment substantially plane-parallel to said first sheet and spaced above said products;

a pre-shaping device for pre-shaping the second sheet before the second sheet contacts said spaced-apart products;

a sealing device for sealing the first and second sheets together between said spaced-apart products, said sealing device having sealing ribs extending transversely to the transport direction and disposed between said spaced-apart products; and synchronizing means for moving said sealing device at the same speed as said sheets while sealing said sheets together between said spaced-apart products;

wherein the pre-shaping device comprises:

a rotating first shaping drum on one side of a moving second sheet; and a rotating second shaping drum on the opposite side of the second sheet, wherein each of said shaping drums comprises shaping ribs protruding from the cylindrical surface of the drum, and wherein the shaping ribs of the first shaping drum and the shaping ribs of the second shaping drum co-operate to move between each other while contacting the second sheet.

2. The device of claim 1, wherein at least one suction device is located on the first shaping drum between the protruding shaping ribs.

3. The device of claim 2, wherein the at least one suction device at least partially pre-shapes the second sheet.

4. The device of claim 1, wherein the sealing ribs protrude from the cylindrical surface of a rotating drum.

5. The device of claim 1, wherein the sealing ribs comprise the protruding shaping ribs of the first shaping drum.

6. The device of claim 1, wherein at least the rotating first shaping drum is positioned such that it guides the moving second sheet towards the moving first sheet.

7. The device of claim 1, wherein the sealing device is an ultrasonic sealing device.

8. The device of claim 7, wherein the sealing device comprises co-operation between an ultrasonic welding device and the sealing ribs.

9. The device of claim 1, further comprising a scoring or perforating device for scoring or perforating the sealed sheets between the individual or grouped products.

10. The device of claim 1, further comprising a separation drum to separate the individual or grouped products into arrays.

* * * * *